US006079107A

United States Patent [19]

Horvath

[11] Patent Number: 6,079,107

[45] Date of Patent: Jun. 27, 2000

[54] TRIMMING DEVICE FOR BEARDS

[76] Inventor: Joseph Paul Horvath, 105 E. Hardin St., Greeneville, Tenn. 37745

[21] Appl. No.: 09/075,996

[22] Filed: May 11, 1998

[51] Int. Cl.[7] ..... B26B 13/20; B26B 13/24

[52] U.S. Cl. ..... 30/233.5; 30/257

[58] Field of Search ..... 30/195, 233, 233.5, 30/254, 257

[56] References Cited

U.S. PATENT DOCUMENTS

| | | | |
|---|---|---|---|
| D. 236,681 | 9/1975 | Megna | 30/233.5 |
| 583,005 | 5/1897 | Volland | 30/233.5 |
| 1,294,998 | 2/1919 | Billy | 30/233.5 |
| 2,328,975 | 9/1943 | Hammond | 30/233.5 |
| 2,489,168 | 11/1949 | Tuck | 30/233.5 |
| 2,532,921 | 12/1950 | Kashian | 30/233.5 |
| 2,721,385 | 10/1955 | Ames | 30/233.5 |
| 2,760,264 | 8/1956 | Javits | 30/257 |

FOREIGN PATENT DOCUMENTS

| | | | |
|---|---|---|---|
| 3498 | of 1867 | United Kingdom | 30/233.5 |
| 132182 | 9/1919 | United Kingdom | 30/233.5 |

*Primary Examiner*—Hwei-Siu Payer
*Attorney, Agent, or Firm*—Malcolm G. Dunn

[57] ABSTRACT

A trimming device for one hand self-use for trimming beards and including first and second blade members, each blade member having a sickle-shaped configuration and having a pivotal connection to the other blade member within the crown portion of the sickle-shaped configuration. Each blade member has a handle defining a finger opening and a blade having a cutting edge, and the pivotal connection for the blade members is located to one side of the trimming device, while the handles and the blades are all located at the other side of the trimming device. In an alternate embodiment, a comb element is readily attachable to and detachable from the first blade member.

7 Claims, 3 Drawing Sheets

TRIMMING DEVICE FOR BEARDS

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to hair cutting devices, and more particularly to a trimming device for one hand self-use in trimming, preferably a person's beard, although it may also be used to trim the hair on a person's head.

Typical scissors for cutting hair and the like in the prior art, such as the ones disclosed in the Megna patent, U. S. Design Pat. No. 236,681 (1975), generally have two cutting blades pivotally connected together at one point along their respective lengths, with the cutting edge of one cutting blade facing the cutting edge of the other cutting blade, and both cutting blades are located on the same side of the pivotal connection. Each cutting blade has at its opposite end a handle by which its pivotal movement toward and away from the other cutting blade is controlled by one of the fingers of a person's hand to cause relative sliding movement of its cutting edge against and past the cutting edge of the other cutting blade parallel to the plane of their contact for a cutting or trimming action. Both handles are generally located at one end of the scissors on the opposite side of the pivotal connection from the two cutting blades, which are located at the other end of the scissors. Any slight movement of the wrist in using such scissors for controlling the handles and hence controlling the guiding of the cutting blades toward or away from the face translates into a greater movement of the cutting blades than the movement of the handles, and the longer the cutting blades are, the greater still is the movement of the farthest point of the cutting blades toward or away from the face. Also, the weight of the cutting blades is cantilevered from the handles, as held by the user.

Since the only effective way one can trim one's own beard with reasonable satisfying results requires the use of a mirror to view the position of the cutting blades relative to the face, and then attempt to visually coordinate what one sees in the mirror and control the positioning of the blades by appropriately moving the wrist and or arm of the hand holding the scissors. This visual coordination and control of the movement of the hand through use of a mirror is not easy because one generally has the conscious feeling of where the hand is positioned, without regard to what one sees in the mirror. If one then applies this conscious feeling toward controlling the movement of the hand, the resulting movement is often different and undesired from what actually occurs when viewing the action in the mirror. The resulting movement is often initially awkward, to say the least, until by practice one becomes accustomed to it. But it is often tiring, whether one becomes accustomed to it or not.

The inventor, has overcome such awkwardness by his trimming device in which both blades and also both handles for controlling the blades are located on the same side of the trimming device while the pivotal connection for the blade members is located on the other side of the trimming device, and in such manner that in use of the trimming device both the handles and the blades will be located directly over and will be supported by the hand holding the trimming device against the beard. The distance of the movement, and here such "movement" is not meant the pivotal movement of the blade members, but rather the movement of the wrist or arm, in controlling the direction of movement of the handles and hence the direction of movement of the blades toward or away from the face, translates essentially to the same distance of movement for the blades as for the distance of movement for the handles. In operation, and assuming the trimming device is being held in the right hand of the user for trimming the beard on the right side of the face, the ends of the cutting blades point toward the rear of the user's head, while the right hand is positioned so that the heel of the hand faces in a natural position of the hand toward the front of the user's head, and the right thumb controls the pivoting action of the one blade member, while the right index finger maintains the other blade member in relatively fixed and non-moving position against the beard at the location where the user wants the trimming action to occur. When trimming the beard on the left side of the face, the heel of the right hand then faces toward the rear of the user's head and the ends of the blades point toward the front of the user's head. In this manner also, the weights of both the blade members and the handles are concentrated directly above the hand in its natural position in the positions described above for the right hand in use of the trimming device. There is, therefore, less strain on the hand and arm of the user during the trimming action. Although the blade members of the trimming device of the invention are shown herein as being used by the right hand of the user, the trimming device can also be made so that it may be used by a left-handed user with similar results, and therefore, the trimming device of the invention may be manufactured either for right-handed or for left-handed users.

In an alternate embodiment of this invention, a comb element may also be attached to the one blade member that is to be positioned against the user's beard in relatively fixed and non-moving position to achieve an effective and satisfying trim of the user's beard. The Volland patent, U. S. Pat. No. 583,005 (1897), is an early example of the use of a comb element on a "hair cutting machine" but where the cutting blades are located on one side of the hair cutting machine and its pivotal connection and the handles are located on the opposite side of the hair cutting machine and its pivotal connection. The Tuck patent, U. S. Pat. No. 2,489,168 (1949), discloses a comb element in use with a scissors arrangement, but where control of the scissors occurs by the provision of a third handle so that the user uses both hands to guide the scissors in cutting hair. The Kashian patent, U. S. Pat. No. 2,532,921 (1950), discloses still another example of a comb element attached to one of the cutting blades, but the scissors and comb combination is operated like a clipping device where the handles are held by the user at essentially right angles with respect to the user's head away from the head rather than in typical essentially parallel relation to the user's head, as is the case with the other scissors mentioned above and with the trimming device of the invention disclosed herein.

The Ames patent, U. S. Pat. No. 2,721,385 (1955), discloses a hair cutting device having a non-moving blade and a movable blade, which is spring-biased to the open position away from the other blade. The device has an elongated sheet-like flat handle, which extends at right angles away from the two blades; a comb, which may be formed by bending up one edge of the sheet-like flat handle; and a guide leaf, which projects from and is parallel to the comb to assist in guiding the comb away from the head. The sheet-like flat handle may either be gripped between the extended fingers (between the second and third fingers) of the left hand while the fingers of the right hand press the movable blade down against its spring-bias toward the non-moving blade in a cutting action, or the sheet-like flat handle may be gripped between the fingers and thumb of the user's hand and the movable blade pressed down against its spring-bias by the other fingers of the same hand. This device, also unlike the other devices of the prior art described above, has the blades, comb and the major portion of the length of the sheet-like handle disposed on one side of the pivotal connection for the movable blade.

BRIEF SUMMARY OF THE INVENTION

The invention is directed to a trimming device for one hand self-use, and includes first and second blade members, each having a sickle-shaped configuration and having a pivotal connection to the other blade member within the crown portion of the sickle-shaped configuration. Each blade member at one end from the pivotal connection has a handle and at the other end has a blade, the handle and the blade each being formed at an acute angle with respect to the other. The handle of the first blade member defines a finger opening, which is sized to receive the index finger of the user, and the handle of the second blade member defines a finger opening sized to receive the thumb of the user. The blade of the first blade member has a cutting edge formed along a portion of the outside edge of the sickle-shaped configuration and the blade of the second blade member has a cutting edge, which is formed along a portion of the inside edge of the sickle-shaped configuration and which faces toward the cutting edge of the first blade member. Each blade is adapted for relative sliding movement of the cutting edge of the blade against and past the cutting edge of the other blade parallel to the plane of their contact for trimming a user's beard. The acute angle between the handle and the blade of the first blade member is to such extent that the cutting edge of the first blade member in operation of the trimming device lies essentially in a horizontal plane directly above and over the handle and the finger opening of the first blade member, the length of the handle and its finger opening crossing diagonally under the length of the cutting edge of the first blade member.

The pivotal connection for the first and second blade members is located to one side of the trimming device, and the handles and blades for the first and second blade members are all located on the other side of the trimming device.

The length of the second blade of the second blade member is less than the length of the handle of the second blade member.

The trimming device has an open position preparatory for a trimming action and a closed position at the conclusion of the trimming action, and in the closed position the handle and finger opening of the second blade member is positioned between the cutting edge of the blade of the first blade member and the handle and finger opening of the first blade member.

In an alternate embodiment of the invention, the trimming device includes a comb element having teeth extending from the comb element, and the comb element is positioned on one side of and extends along at least a portion of the cutting edge of the first blade member.

The cutting edge of the first blade member is approximately level with the location where the teeth extend from the comb element.

The comb element is attachable to and detachable from the first blade member of the trimming device.

DETAILED DESCRIPTION OF THE INVENTION

Figure 2:
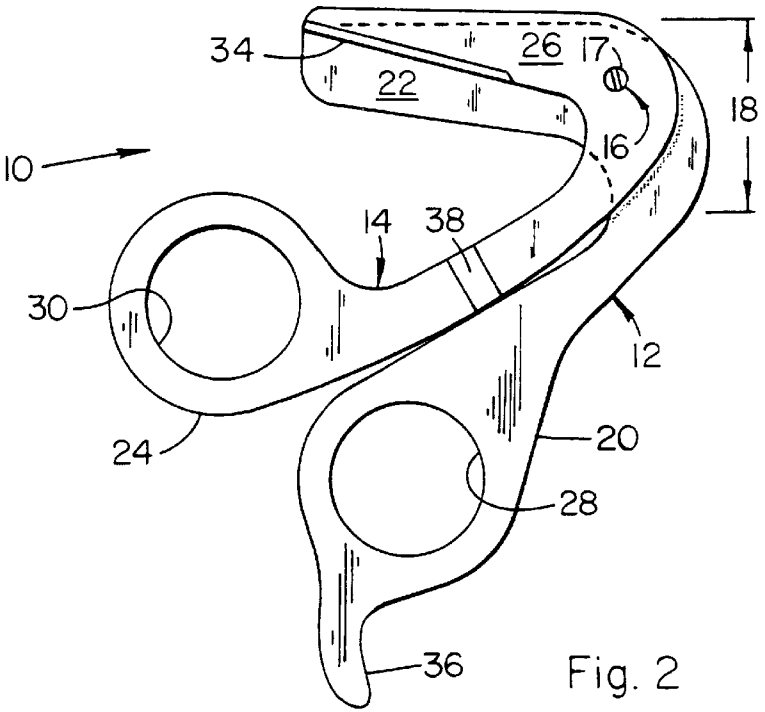
FIG. 2 is a plan view of the trimming device showing both blade members in the closed position.
Figure 1:
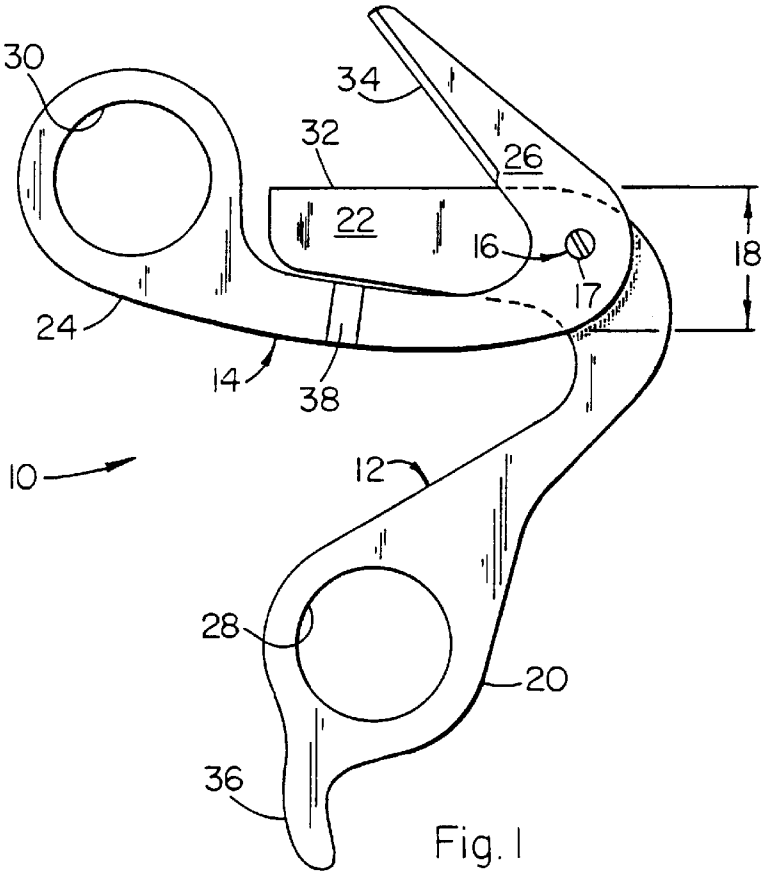
FIG. 1 is a plan view of the trimming device of the invention showing the second blade member in the open position with its cutting edge facing the cutting edge of the first blade member.

In reference to FIGS. 1 and 2 of the drawings, the trimming device of the invention is shown at 10. The device includes a first blade member 12 and a second blade member 14, each having a sickle-shaped configuration and a pivotal connection 16 provided by the screw 17 extending through suitably formed openings in both blade members within the crown portion designated in FIG. 1 generally at 18. The crown portion is the apex part of the sickle-shaped configuration for each blade member.

The first blade member 12 has at one end from the pivotal connection 16 a handle 20 and at the other end a blade 22, and the second blade member 14 has at one end from the pivotal connection 16 a handle 24 and at the other end a blade 26. Each handle and each blade are formed at an acute angle with respect to each other.

The handle 20 of the first blade member 12 defines a finger opening 28 sized to receive the index finger of the user. The handle 24 of the second blade member 14 defines a finger opening 30 sized to receive the thumb of the user.

The blade 22 of the first blade member 12 has a cutting edge 32, which is formed along a portion of the outside edge of the sickle-shaped configuration, and the blade 26 of the second blade member 14 has a cutting edge 34, which faces toward the cutting edge 32 of the first blade member 12. Each blade, therefore, is adapted for relative sliding movement of the cutting edge of the blade against and past the cutting edge of the other blade parallel to the plane of their contact for trimming the user's beard.

It should be noted that the pivotal connection 16 for the first blade member 12 and for the second blade member 14 is located to one side of the trimming device 10, and the handles 20, 24 and the blades 22, 26 for the first and second blade members are all located at the other side of the trimming device.

Figure 5:
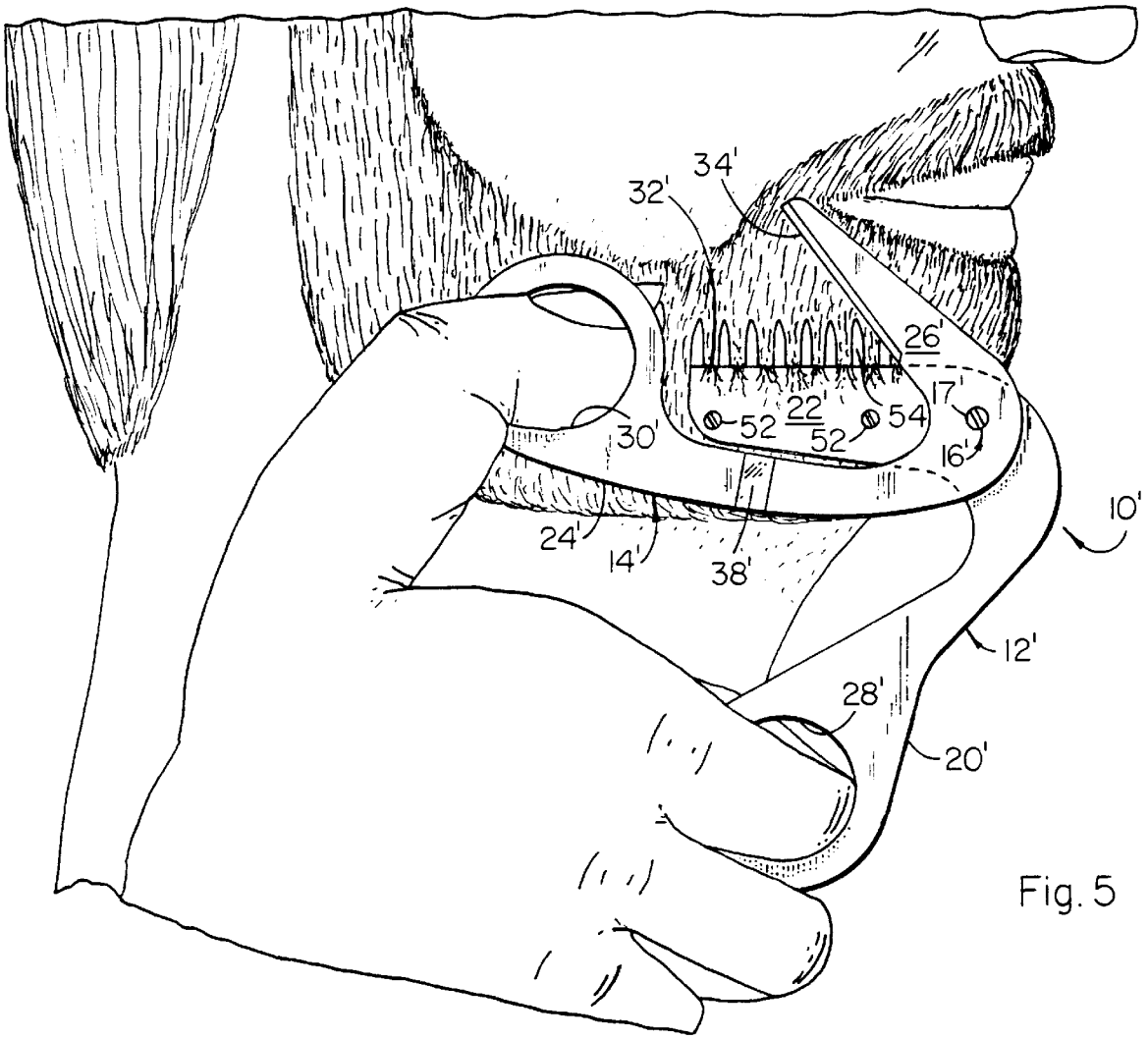
FIG. 5 is a view of the alternate embodiment of the trimming device of FIG. 3 being held in the right hand of the user and illustrating the comb element and the blade members being positioned against the beard of the user for a trimming action.

In the operation of the trimming device 10, the acute angle between the handle 20 and the blade 22 of the first blade member 12 is to such extent that the cutting edge 32 of the first blade member 12 will lie essentially in a horizontal plane directly above and over the handle 20 and the finger opening 28 of the first blade member 12, as may be observed from FIG. 5 of the alternate embodiment to be described.

The length of the second blade 26 of second blade member 14 is less than the length of the handle 24 of the second blade member 14.

As may be observed from FIG. 2, which shows both blade members in the closed position of the trimming device, the handle 24 and finger opening 30 of the second blade member 14 is positioned between the cutting edge 32 of the blade 22 of the first blade member 12 and the handle 20 and the finger opening 28 of the first blade member 12.

An offset bend 38 may be provided intermediately along the length of the handle 24 of the second blade member 14, if desired, to serve as a positive stop against movement in one direction of the second blade member 14 over the lower portion of the blade 22 of the first blade member 12 or movement in the other direction over the handle 20 of the first blade member 12.

In operating the trimming device 10, and assuming operation with the right hand of the user, the user inserts his right thumb through the finger opening or thumb opening 30 of the second blade member 14 and his index finger through the finger opening or index finger opening 28 of the first blade member 12. The user's third or middle finger will generally engage against the inside curve of the curved tang portion 36, which is adjacent the finger opening or index finger opening 28. In trimming a user's beard on the right side of the face, for example, the outside face of the first blade member 12 adjacent the cutting edge 32 is positioned against the beard in such manner that the cutting edge 32 is essentially aligned horizontally to or parallel to and against the right side of the user's face, and then the index finger and the first blade member 12 is held relatively fixed and non-moving at the location where the user wants to trim his beard. The user moves his right thumb up and down to cause the second blade member 14 to move relative to the first blade member 12 in a trimming action. The user's heel of his right hand, when on the right side of the user's face, will face generally toward the front of the user's head, while both blade members will point toward the rear of the user's head and will be positioned above and over the user's right hand so that the weight of the blade members and their finger openings will be directed toward the hand, as compared to prior art scissors wherein the blade members and the weight thereof are cantilevered to extend from the user's hand. There is, therefore, less strain on the user's hand in supporting and controlling the movement of the trimming device during the trimming action.

Generally, the user will want to move the trimming device along a horizontal path or in horizontal rows with respect to his face so as to trim evenly and effectively. When the user trims his beard on the left side of his face, he shifts his right hand to that side so that again the cutting edge 32 of the first blade member 12 is positioned next to the face essentially horizontally aligned. In this manner, the heel of the user's right hand now faces generally toward the rear of the user's head while the ends of the blades point toward the front of the user's hand.

As previously mentioned, if the user normally uses his left hand, the trimming device may be modified to fit a left handed user so as to operate in a similar manner for left handed usage.

Figure 4:
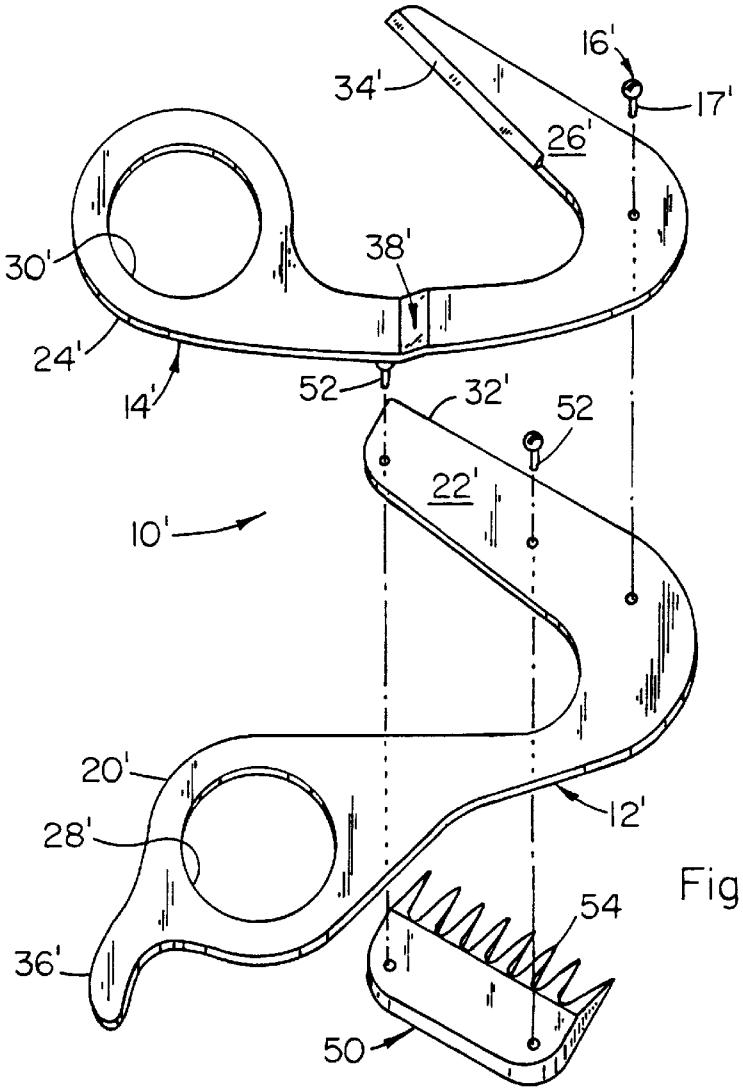
FIG. 4 is an exploded view of the alternate embodiment of the trimming device shown in FIG. 3.
Figure 3:
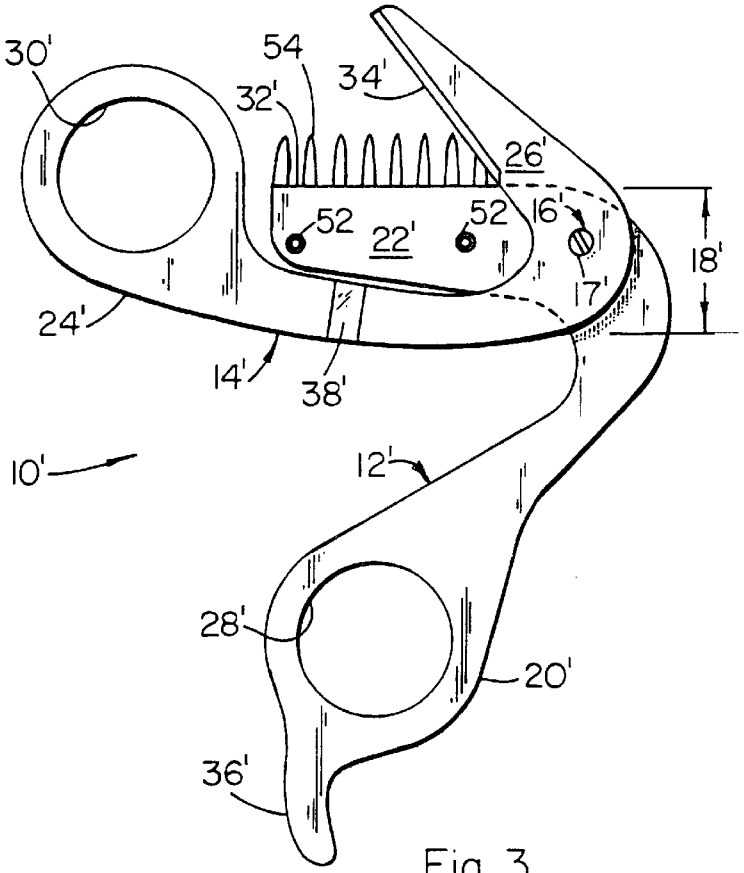
FIG. 3 is a plan view of an alternate embodiment of the trimming device showing a comb element and its teeth with the comb element being attached to the first blade member with the second blade member being shown in its open position relative to the first blade member.

In an alternate embodiment, which is shown in FIGS. 3–5, those elements of the invention previously described and identified above with respect to the description of the first embodiment of the invention are identified in these figures of the drawing by use of the same reference numbers except that each is followed with the addition of a prime mark, while the additional elements not previously described and identified are each identified with their own reference numbers.

The trimming device 10' of the alternate embodiment includes a comb element 50 attached to the side of the first blade member 12' that is to be positioned directly against the beard of the user, as may be observed from FIG. 5, and also from the exploded view shown in FIG. 4. The comb element 50 may be secured to the first blade member 12' by the two screws 52 extending into suitable threaded holes provided in the first blade member 12', the screws 52 being more clearly shown in the exploded view of FIG. 4, with the heads of the screws 52 being designed to lie flush on the one side of the first blade member 12' so as not to interfere with the trimming action of the two blade members.

The comb element 50 has teeth 54 extending from the comb element 50, and as may be observed from FIG. 3, the cutting edge 32' of the first blade member 12' is approximately level with the location where the teeth extend from the comb element.

The comb element 50 may be readily attachable and detachable from the first blade member 12' of the trimming device 10' by means of the aforementioned screws 52.

The operation of the trimming device of the invention is essentially similar as that of the first embodiment with the exception that the user in trimming from the bottom toward the top of his beard, will with upward stroke work the hairs of the beard into the teeth 54 of the comb element 50 and the cutting edge 32' of the first blade member 12'. The teeth 54 serve to pull the hair of the beard away from the face so that the user may determine how short the hairs should be before moving the second blade member 14' in a trimming action.

The invention has been described in detail with particular reference to preferred embodiments thereof, but it will be understood that variations and modifications can be effected within the spirit and scope of the invention.

I claim:

1. A trimming device for one hand self-use and comprising first and second blade members, each having a sickle-shaped configuration and having a pivotal connection to the other blade member within the crown portion of the sickle-shaped configuration;

each blade member at one end from said pivotal connection having a handle and at the other end a blade, said handle and said blade each being formed at an acute angle with respect to the other;

the handle of said first blade member defining a finger opening sized to receive the index finger of a user and the handle of said second blade member defining a finger opening sized to receive the thumb of the user;

the blade of said first blade member having a cutting edge formed along a portion of the outside edge of said sickle-shaped configuration and said blade of said second blade member having a cutting-edge formed along a portion of the inside edge of said sickle-shaped configuration and facing toward the cutting edge of said first blade member, each blade adapted for relative sliding movement of the cutting edge of the blade against and past the cutting edge of the other blade parallel to the plane of their contact for trimming a user's beard;

and wherein the acute angle between the handle and the blade of the-first blade member is to such extent that the cutting edge of said first blade member in operation of the trimming device lies essentially in a horizontal plane directly above and over the handle and the finger opening of said first blade member, the length of said handle and its finger opening crossing diagonally under the length of the cutting edge of said first blade member.

2. A trimming device for one hand self-use as defined in claim 1, and wherein the pivotal connection for said first and second blade members is located to one side of said trimming device and the handles and blades for said first and the second blade members are all located at the other side of said trimming device.

3. A trimming device for one hand self-use as defined in claim 1, and wherein the length of said blade of said second blade member is less than the length of the handle of said second blade member.

4. A trimming device for one hand self-use as defined in claim 1, and wherein said trimming device has an open position preparatory for a trimming action and a closed position at the conclusion of the trimming action and in the closed position the handle and the finger opening of the second blade member is positioned between the cutting edge of the blade of the first blade member and the handle and the finger opening of the first blade member.

5. A trimming device for one hand self-use as defined in claim 1, and wherein said trimming device includes a comb element having teeth extending from the comb element and is positioned on one side of and extending along at least a portion of the cutting edge of said first blade member.

6. A trimming device for one hand self-use as defined in claim 5, and wherein said cutting edge of said first blade member is approximately level with the location where the teeth extend from the comb element.

7. A trimming device for one hand self-use as defined in claim 5, and wherein said comb element is attachable to and detachable from said first blade member of said trimming device.

* * * * *